United States Patent [19]

Edney et al.

[11] 4,363,451

[45] Dec. 14, 1982

[54] DEVICE FOR BREAKING A HARD MATERIAL

[76] Inventors: Barry E. Edney, Servion; Alain Zurcher, Pampigny, both of Switzerland

[21] Appl. No.: 199,937

[22] Filed: Oct. 23, 1980

[30] Foreign Application Priority Data

Oct. 23, 1979 [SE] Sweden ..... 7908750

[51] Int. Cl.[3] ..... B02C 19/00

[52] U.S. Cl. ..... 241/39

[58] Field of Search ..... 241/39, 40, 5

[56] References Cited

U.S. PATENT DOCUMENTS 2,830,769 4/1958 Work ..... 241/39 X 2,928,614 3/1960 Emanuel et al. ..... 241/39

3,458,139 7/1969 Edebo ..... 241/39 X

*Primary Examiner*—Willie G. Abercrombie

[57] ABSTRACT

A liquid jet cannon having a reciprocably movable piston device (6). The piston device is held in cocked position against the action of a gas pressure accumulator (19) by liquid pressure in a first chamber (15) until initiation of a power stroke. The power stroke is initiated by depressurization of a control chamber (16), whereby a valve (11) is moved to its open position so that a flow communication (39) is created between the first chamber (15) and a second chamber (17). The first chamber is thus rapidly depressurized so that the pressure in the gas pressure accumulator (19) drives the piston device (6) into a liquid chamber (14) to produce a liquid jet pulse for breakage of the hard material.

5 Claims, 1 Drawing Figure

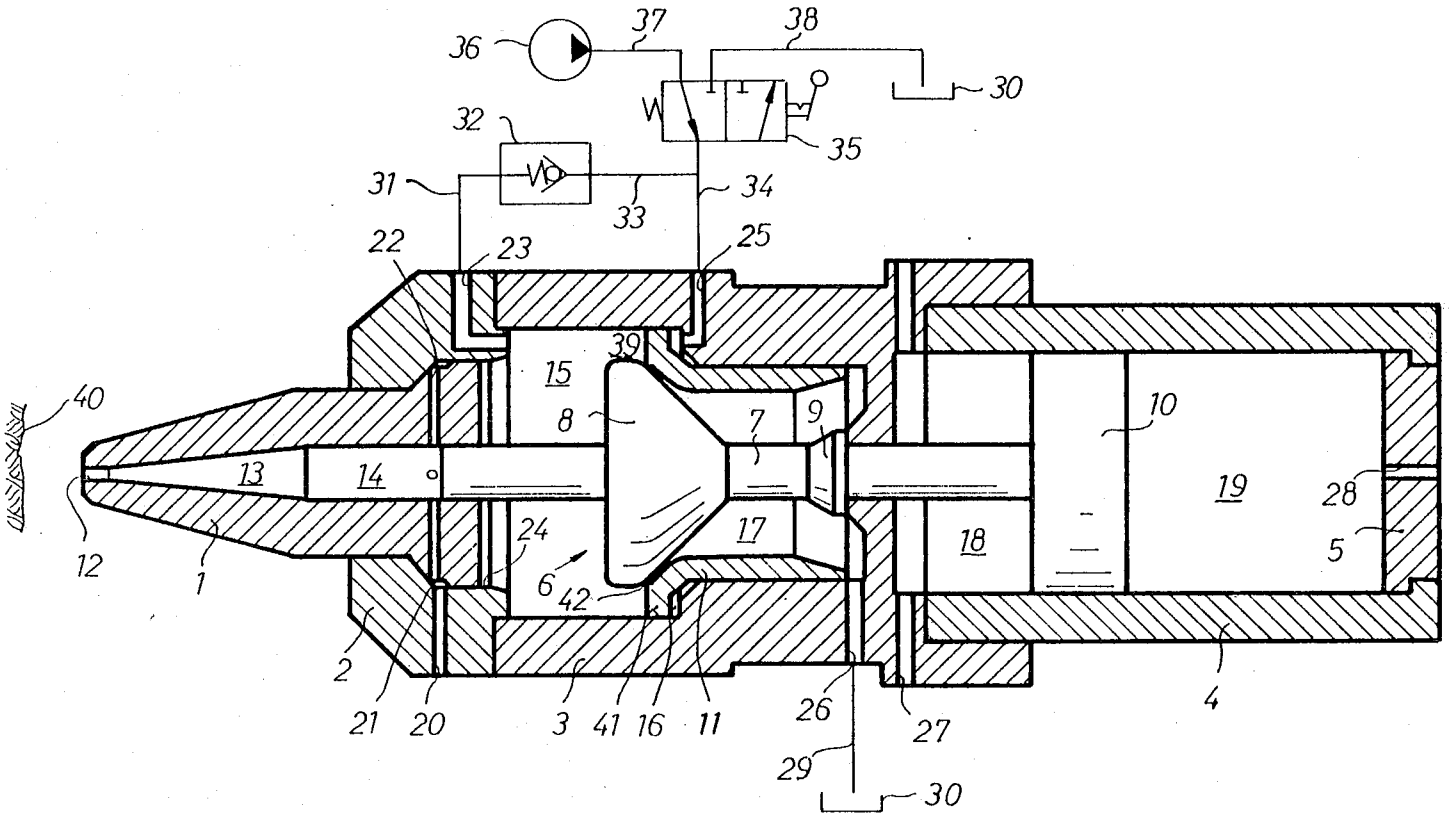
28
5
19
4
10
18
30
27
30
35
38
9
26
29
34
25
7
17
11
37
33
39
16
41
3
8
42
6
15
24
36
32
23
20
31
22
21
14
2
13
1
40
12

DEVICE FOR BREAKING A HARD MATERIAL

The present invention relates to a device for breaking hard materials, e.g. breaking rock or concrete, piercing metal plates, boulder splitting or the like. This is obtained either directly by the impact of a piston or indirectly by a liquid jet pulse produced by the device.

In a prior art device for breaking hard materials by means of water jet pulses a piston device is driven into a water chamber by the pressure in a gas pressure accumulator to produce a water jet pulse. In order to return the piston device to the cocked position hydraulic fluid is applied to a piston being movable along the piston device. Water is then supplied to the water chamber via a check valve. Then the cocking piston is moved so that it does not interfere with the piston device during the power stroke. To make this possible arrangements have been made so that the gas pressure accumulator does not load the piston device axially until the power stroke has been initiated. To initiate the power stroke pressure is applied to the end surface of the piston device via a gas expansion and trigger chamber. The piston device is in this way moved somewhat so that the gas in the gas pressure accumulator reaches the end surface of the piston device, whereby the power stroke is obtained. The combined gas expansion and trigger chamber, apart from being used to initiate the power stroke, takes care of gas leaking from the gas pressure accumulator so that accidental initiation of the power stroke is avoided. In order to control the operation of the prior art device several valves are needed.

According to the present invention, which is defined in the subsequent claims, a device for breaking hard materials is created in which a piston device comprising a first piston is loaded by pressurized liquid against the action of a gas pressure accumulator until a power stroke is initiated by the opening of a valve means. When the valve means is opened the liquid pressure rapidly drops so that the piston device is released to perform its power stroke. The hard material can be broken either by direct impact of the piston device or indirectly by letting the piston device extrude a liquid jet pulse through a nozzle against the hard material. The advantage of the device according to the present invention compared to the above mentioned prior art device is that fewer valves are needed to control the operation. Furthermore, there is no need to take care of gas leaking from the accumulator to avoid accidential initiation of the power stroke since the piston device is loaded towards its cocked position by the pressurized liquid until the power stroke is initiated.

According to an advantageous embodiment of the invention the valve means comprises a cylindrical sleeve provided with a radially outwardly directed flange and means for cooperation with the first piston. Initiation of the power stroke is then obtained when the pressure in a control chamber defined by the valve means and the housing is unloaded. Preferably the means for cooperation with the first piston is situated radially outwardly of the outer diameter of the cylindrical sleeve so that substantially the same pressure can be used in the control chamber as for cocking of the piston device.

The device is, furthermore, advantageously provided with a nozzle having a liquid supply being valved by the piston device.

An embodiment of the invention is described below with reference to the accompanying drawing which shows a section through a liquid jet device according to the invention.

The device shown in the drawing is a liquid jet cannon comprising a housing which incorporates a front part 2, a middle part 3 and a rear part 4. The rear part is provided with an end plate 5 having a hole 28 for connection of a not shown gas pressure supply. A front piece 1 has been pressed into front part 2. Front part 2 is provided with a hole 20 for supply of liquid, e.g. tap water, from a not shown source to an annular space 21 formed in front piece 1. The front piece is provided with a number of holes 22 which connect the annular space 21 with a cylindrical inlet section 14. Front piece 1 further comprises a converging nozzle section 13 and a cylindrical outlet section 12. A piston device 6 comprising a central portion or rod 7, a first piston 8 and a second piston 10 fixed on the rod is reciprocably movable in the housing. Rod 7 is furthermore provided with a collar 9 to limit the backwards movement of the piston device. The front end of rod 7 acts as a valve for the supply of liquid to inlet section 14 during operation of the liquid jet cannon. A gas pressure accumulator 19 is formed by housing part 4, end plate 5 and second piston 10, which acts as a movable end wall. Chamber 18 communicates via a number of holes 27 with the surrounding atmosphere so that substantial braking of piston device 6 during its power stroke is avoided. The device is furthermore provided with a first chamber 15 in front of first piston 8 and a second chamber 17 behind first piston 8. Between these chambers a flow communication 39 controlled by valve means 11 is provided. The valve means comprises a cylindrical sleeve 11, which is provided with a radially outwardly extending flange 41 and means 42, in form of an annular ridge, for cooperation with first piston 8. Ridge 42 is situated radially outwardly of the outer diameter of sleeve 11 so that the area of flange 41 exposed to the pressure in first chamber 15 is somewhat smaller than the area exposed to the pressure in control chamber 16. Because of this valve means 11 is held in contact with first piston 8 as long as the pressure in control chamber 16 is substantially equal to the pressure in first chamber 15. First chamber 15 is at its front end provided with an extension 24 to stop first piston 8 at the end of the power stroke of piston device 6 so that direct impact between first piston 8 and front piece 1 is avoided. Second chamber 17 is via a hole 26 and a conduit 29 connected to a sump 30. First chamber 15 is via a channel 23, conduit 31, spring-loaded check valve 32, conduit 33 and conduit 34 connected to a trigger valve 35. Control chamber 16 is via a channel 25 and conduit 34 connected to trigger valve 35. Trigger valve 35 is via a conduit 37 connected to pump 36 and via a conduit 38 to the sump 30. Pump 36 is furthermore, if hydraulic fluid is used, connected to suck the fluid from the sump 30. If water is used the suction side of pump 36 is connected to a supply of water.

The device shown in the drawing is operated in the following way. The device is in the drawing shown in the cocked position, i.e. ready to produce a liquid jet pulse onto the hard material 40 situated in front of the nozzle 1. The pressure is about 300 bar in gas pressure accumulator 19 and about 350 bar in first chamber 15 and control chamber 16. The pressure in chamber 15 is somewhat lower than in chamber 16 because of the force of the spring of check valve 32. Tap water is supplied so that inlet section 14, nozzle section 13 and outlet section 12 are filled with water. Valve means 11 is held in contact with first piston 8 because of the above mentioned design so that pressurized liquid is prevented from flowing from first chamber 15 to second chamber 17. A power stroke is then initiated by pushing the trigger valve 35 to the position opposite to the one shown. Control chamber 16 is thus connected to sump 30. The pressure in first chamber 15 then pushes valve 11 to its open position so that a flow communication 39 is opened between chambers 15 and 17. The pressure in chamber 15 then rapidly drops so that piston device 6 is pushed forward by the pressure in gas pressure accumulator 19. In this way a water jet pulse having a velocity of about 1000–1500 m/s and a duration of about 3 m/s is created. After the power stroke, trigger valve 35 is returned to the position shown in the drawing. Pump 36 now supplies pressurized liquid to first chamber 15 and control chamber 16. This will first result in a forward movement of valve 11 until it contacts piston 8. Then piston device 6 together with valve 11 will be moved backwards by the liquid flowing into first chamber 15. This movement is stopped when collar 9 contacts the housing. The cycle is then repeated until the hard material 40 has been broken.

If front part 2 and front piece 1 are replaced by a front part having smaller width, the central portion 7 of the piston device will extend sufficiently much beyond the housing at the end of the power stroke to be used as a hammer. In this way the device can be used for breakage of the hard material by direct impact.

I claim:

1. A device for breaking a hard material, said device comprising a housing (2, 3, 4), a gas pressure accumulator (19) in said housing, a piston device (6) reciprocably movable in said housing and a valve means (11), characterized thereby that said piston device (6) comprises a first piston (8) being situated between a first chamber (15) and a second chamber (17) in said housing (2, 3, 4) and a second piston (10) acting as a movable end wall of said gas pressure accumulator (19), said valve means (11) being movable between a closed position in which it cooperates with said first piston (8) to prevent pressurized liquid from flowing from said first chamber (15) to said second chamber (17) and an open position establishing a flow communication (39) between said first and second chambers, whereby said first chamber is rapidly depressurized so that the gas pressure in said gas pressure accumulator (19) drives said piston device (6) in a power stroke to cause, directly or indirectly, breakage of the hard material.

2. A device according to claim 1, characterized thereby that said housing (2, 3, 4) is provided with a front piece (1) comprising a bore having a cylindrical inlet section (14), a converging nozzle section (13) and an outlet section (12), and that a central portion (7) of said piston device (6) extends into said inlet section (14).

3. A device according to claim 2, characterized thereby that said front piece (1) is provided with channel means (22) for supplying liquid to said cylindrical inlet section (14) and that said central portion (7) of the piston device (6) acts as a valve which interrupts said supply of liquid during the major part of the power stroke.

4. A device according to any one of claims 1, 2 or 3, characterized thereby that said valve means comprises a cylindrical sleeve (11) provided with a radially outwardly extending flange (41) and means (42) for cooperation with said first piston (8), and that a control chamber (16) is formed between the flange, the sleeve and the housing (3).

5. A device according to claim 4, characterized thereby that said means (42) for cooperation with the first piston (8) is situated radially outwardly of the outer diameter of said cylindrical sleeve (11), whereby said valve means is held in contact with said first piston (8) to prevent pressurized liquid from flowing from said first chamber (15) to said second chamber (17) as long as the pressure in said control chamber (16) is substantially equal to the pressure in said first chamber (15).

* * * * *